US009714075B2

(12) United States Patent
Watkins et al.

(10) Patent No.: US 9,714,075 B2
(45) Date of Patent: Jul. 25, 2017

(54) JET BOAT INCLUDING ARTICULATING KEEL

(71) Applicants: Yamaha Motor Corporation, USA, Cypress, CA (US); Yamaha Jet Boat Manufacturing U.S.A., Inc., Vonore, TN (US)

(72) Inventors: Scott Watkins, Canton, GA (US); Ed Miller, Vonore, TN (US)

(73) Assignees: YAMAHA MOTOR CORPORATION, U.S.A., Cypress, CA (US); YAMAHA JET BOAT MANUFACTURING U.S.A., INC., Vonore, TN (US)

( * ) Notice: Subject to any disclaimer, the term of this patent is extended or adjusted under 35 U.S.C. 154(b) by 77 days.

(21) Appl. No.: 14/811,872

(22) Filed: Jul. 29, 2015

(65) Prior Publication Data

US 2017/0029086 A1 Feb. 2, 2017

(51) Int. Cl.

| | |
|---|---|
| ***B63H 11/107*** | (2006.01) |
| ***B63H 25/06*** | (2006.01) |
| ***B63H 11/113*** | (2006.01) |
| ***B63H 11/117*** | (2006.01) |

(52) U.S. Cl.

CPC ..... *B63H 11/113* (2013.01); *B63H 11/117* (2013.01); *B63H 25/06* (2013.01)

(58) Field of Classification Search

CPC ..... B63H 11/00; B63H 11/107; B63H 11/113; B63H 11/117; B63H 25/38; B63H 25/382; B63H 2025/385; B63H 2025/387; B63H 25/46

See application file for complete search history.

(56) References Cited

U.S. PATENT DOCUMENTS

| | | | | |
|---|---|---|---|---|
| 3,108,561 A | | 10/1963 | McNeil et al. | |
| 3,250,072 A | * | 5/1966 | Smith | B63H 11/113 114/151 |
| 3,906,885 A | | 9/1975 | Woodfill | |
| 3,943,876 A | | 3/1976 | Kiekhaefer | |
| 3,976,026 A | | 8/1976 | Eastling | |
| 4,815,995 A | | 3/1989 | Ingvason | |
| 5,094,182 A | * | 3/1992 | Simner | B63H 25/38 114/162 |
| 5,378,179 A | | 1/1995 | Riggle | |
| 5,421,753 A | | 6/1995 | Roos | |
| 5,605,110 A | | 2/1997 | Talbot | |

(Continued)

FOREIGN PATENT DOCUMENTS

JP 10-297595 A 11/1998

*Primary Examiner* — Ajay Vasudeva

(74) *Attorney, Agent, or Firm* — Keating and Bennett, LLP

(57) ABSTRACT

A jet boat includes a hull, a jet propulsion nozzle mounted to a rear of the hull, and an articulating keel attached at the rear of the hull. The articulating keel is connected to the jet propulsion nozzle via a connecting portion such that when the jet propulsion nozzle is turned, at least a portion of the articulating keel is turned with the jet propulsion nozzle. The jet propulsion nozzle turns about a first pivot axis extending vertically or substantially vertically, and the articulating keel turns about a second pivot axis extending vertically or substantially vertically. The first pivot axis of the jet propulsion nozzle is coaxial with the second pivot axis of the articulating keel.

20 Claims, 6 Drawing Sheets

(56) References Cited

U.S. PATENT DOCUMENTS

| | | | | |
|---|---|---|---|---|
| 6,332,816 | B1 * | 12/2001 | Tsuchiya | B63H 11/113 114/162 |
| 6,491,554 | B1 * | 12/2002 | Servais | B63B 1/22 440/40 |
| 7,240,632 | B1 | 7/2007 | Wynne et al. | |
| 9,027,494 | B2 | 5/2015 | Watkins | |
| 2003/0176120 | A1 | 9/2003 | Walkowiak | |

* cited by examiner

JET BOAT INCLUDING ARTICULATING KEEL

BACKGROUND OF THE INVENTION

1. Field of the Invention

The present invention relates to a jet boat. More specifically, the present invention relates to a jet boat including an articulating keel that assists steering of the jet boat.

2. Description of the Related Art

Unlike a boat including an outboard motor that extends below a bottom surface of the hull and includes a skeg at the bottom of the outboard motor that assists in steering the boat even at low speeds, a jet boat includes a jet propulsion nozzle that extends rearward from a rear of the hull and typically uses thrust to steer the jet boat by changing the direction of the thrust from the jet propulsion nozzle. When a jet boat is operated at low speeds, the small amount of thrust from the jet propulsion nozzle provides limited steerability for the jet boat.

SUMMARY OF THE INVENTION

To overcome the problem described above, preferred embodiments of the present invention provide a jet boat including an articulating keel that assists in steering the jet boat even at low speeds.

A jet boat according to a preferred embodiment of the present invention includes a hull, a jet propulsion nozzle mounted to a rear of the hull, an articulating keel attached at the rear of the hull, and a connecting portion that connects the jet propulsion nozzle and the articulating keel. The jet propulsion nozzle includes a first pivot axis extending vertically or substantially vertically, and about which the jet propulsion nozzle turns. The articulating keel includes a second pivot axis extending vertically or substantially vertically, and about which at least a portion of the articulating keel turns. The first pivot axis of the jet propulsion nozzle is preferably coaxial with the second pivot axis of the articulating keel such that when the jet propulsion nozzle is turned during a steering operation of the jet boat, the articulating keel is turned with the jet propulsion nozzle.

The articulating keel preferably includes a fixed portion and a movable portion, wherein the fixed portion is attached to the movable portion at the second pivot axis. The movable portion preferably includes a forward portion located forward of the second pivot axis in a fore and aft direction of the jet boat and a rear portion located rearward of the second pivot axis in the fore and aft direction of the jet boat.

Alternatively, the entire movable portion is located rearward of the second pivot axis in the fore and aft direction of the jet boat.

The fixed portion of the articulating keel is preferably attached directly to the hull. In particular, the fixed portion of the articulating keel is attached directly to a bottom surface of the hull. Alternatively, the fixed portion of the articulating keel is attached directly to a ride plate, which is attached directly to the bottom surface of the hull. The ride plate is preferably made of a material that is suitable to secure the fixed portion of the articulating keel to the surface of the hull.

A front of the fixed portion of the articulating keel is preferably curved, and a curvature of the front of the fixed portion preferably corresponds or substantially corresponds to a curvature of a front of the hull. Similar to when the front of the hull comes into contact with, for example, floating debris in the water and smoothly pushes the floating debris aside or underneath the jet boat, so would the curved front of the fixed portion of the articulating keel.

The movable portion of the articulating keel is preferably located directly below the jet propulsion nozzle. Alternatively, the movable portion of the articulating keel may be located slightly forward or slightly rearward of the jet propulsion nozzle in the fore and aft direction of the jet boat.

The fixed portion of the articulating keel preferably defines a portion of a bottom surface of the hull. In particular, the fixed portion of the articulating keel preferably extends from a bottom surface of the hull.

A rear portion of the fixed portion of the articulating keel preferably extends rearward of the rear of the hull. In particular, the fixed portion of the articulating keel extends rearward from the hull such that a rear end of the fixed portion is aligned with the first pivot axis of the jet propulsion nozzle.

A length of the fixed portion of the articulating keel in the fore and aft direction of the jet boat is preferably between about 2 times to about 3 times a length of the movable portion of the articulating keel in the fore and aft direction of the jet boat. Alternatively, the length of the fixed portion of the articulating keel may be about the same as the length of the movable portion of the articulating keel in the fore and aft direction of the jet boat. It is also possible that the length of the fixed portion of the articulating keel may be many times longer than the length of the movable portion of the articulating keel in the fore and aft direction of the jet boat.

The hull is preferably designed such that a bottom surface of the hull inclines upward as the hull extends rearward. Thus, the front of the hull sits lower in the water than the rear end of the hull. Preferably, the hull inclines upward by a distance that is the same or substantially the same as the distance that the articulating keel extends below a bottom surface of the rear of the hull.

Preferably, a bottom surface of the articulating keel is located on a horizontal line extending rearward from a bottom surface of a front of the hull.

Alternatively, the bottom surface of the articulating keel is slightly above or slightly below the horizontal line extending rearward from the bottom surface of the front of the hull.

The articulating keel is preferably located at a middle of the hull in a width direction of the jet boat.

In a preferred embodiment of the present invention, the jet boat includes a hull that has a flat or substantially flat bottom surface. For example, the hull has a design similar to a so-called "bass boat" that has a shallow draft so as to allow the jet boat to operate in shallow water. Alternatively, the hull includes a keel extending from a front of the hull toward the rear of the hull along a middle of the hull in the width direction of the jet boat. The keel defines a middle and/or a lowermost portion of the hull, wherein the sides of the hull extend upwards from the keel. Preferably, the articulating keel is aligned with the keel of the hull in the fore and aft direction of the jet boat.

A bottom surface of the articulating keel preferably extends below a bottom surface of the hull. Accordingly, the articulating keel provides better steerability for the jet boat when the jet boat is operated at low speeds.

The connecting portion is preferably located rearward of the first pivot axis and the second pivot axis in the fore and aft direction of the jet boat. Preferably, the connecting portion includes a bolt that connects the jet propulsion nozzle to the movable portion of the articulating keel. The connecting portion preferably includes a U-shaped or substantially U-shaped guide plate including a slot in which the articulating keel is located.

The jet boat preferably includes a water intake port in the bottom surface of the hull to provide water to the jet propulsion nozzle. Preferably, the water intake port is aligned with the keel of the hull and located between the keel and the articulating keel.

The above and other features, elements, characteristics, configurations, arrangements and advantages of the present invention will become more apparent from the following detailed description of preferred embodiments of the present invention with reference to the attached drawings.

DETAILED DESCRIPTION OF PREFERRED EMBODIMENTS

Figure 1:
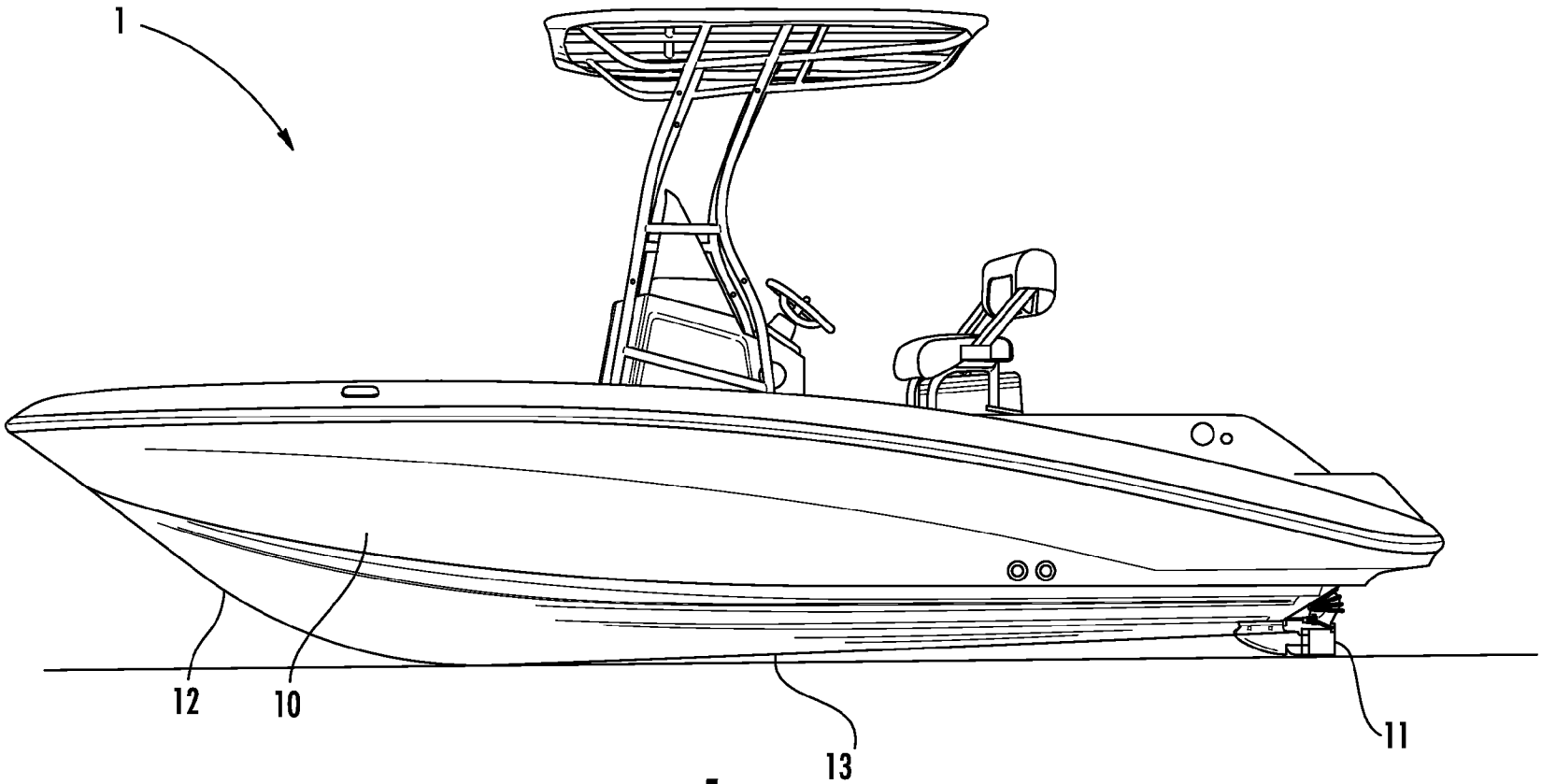
FIG. 1 is a side view of a jet boat according to a preferred embodiment of the present invention.

FIG. 1 shows a jet boat 1 according to a preferred embodiment of the present invention. The jet boat 1 includes a hull 10 and a jet propulsion nozzle 20 mounted at the rear 11 of the hull 10. The jet propulsion nozzle 20 jets water rearward of the jet boat 1 to provide thrust for the jet boat 1. In the present preferred embodiment, the jet boat 1 preferably includes a single jet propulsion nozzle 20, for example.

Figure 5A:
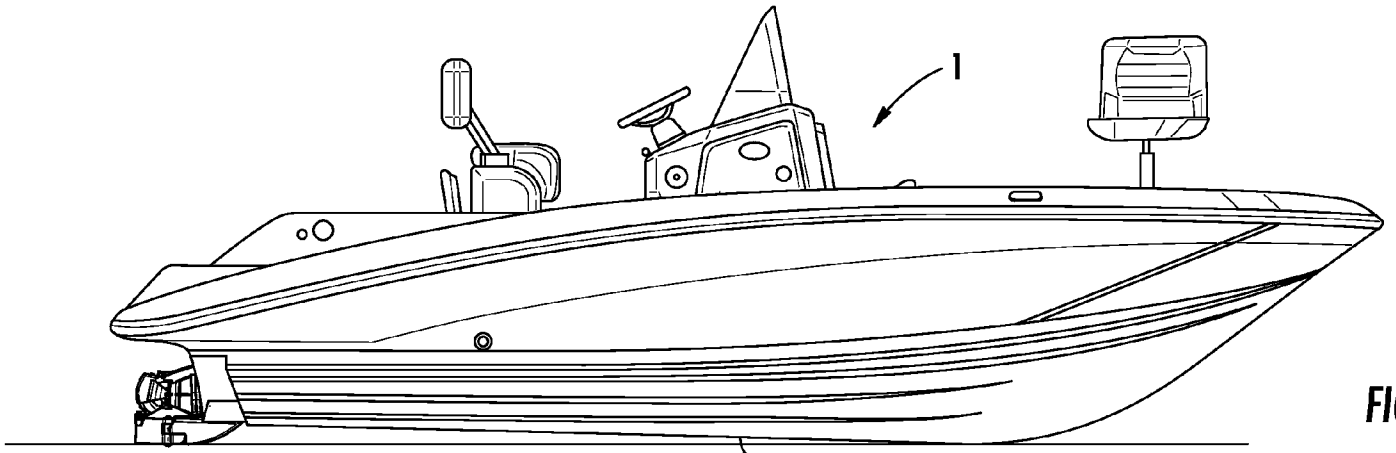
FIGS. 5A and 5B are, respectively, a side view and a bottom view of a jet boat according to a preferred embodiment of the present invention.
Figure 5B:
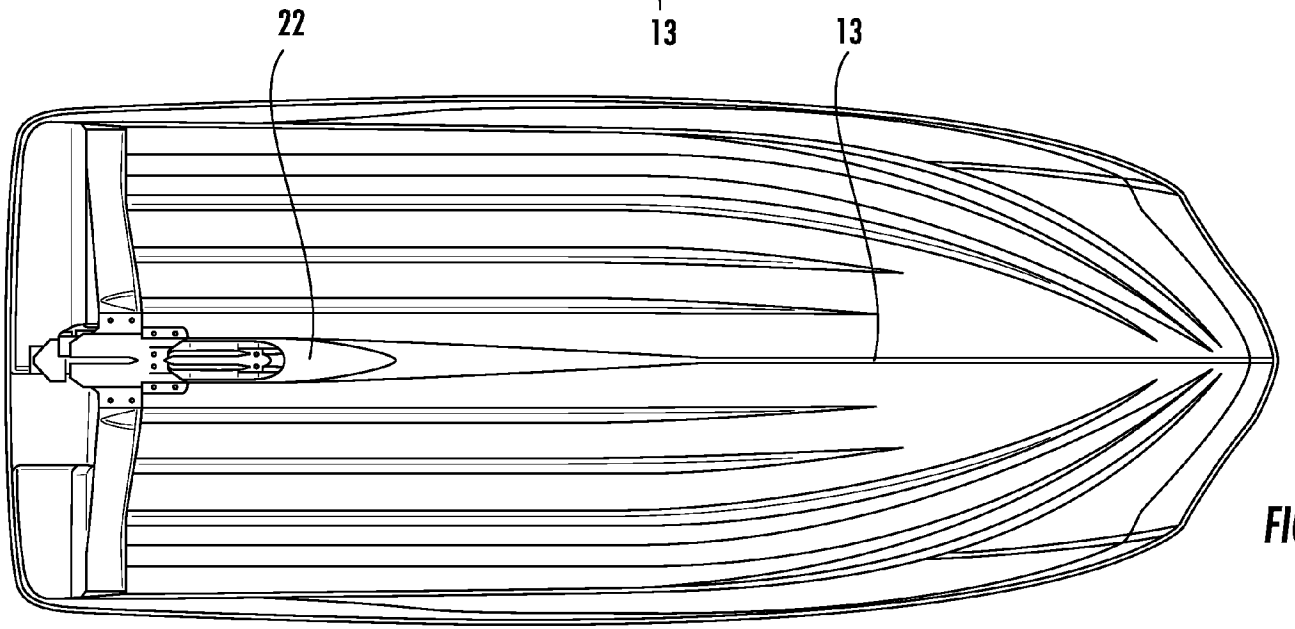

As shown in FIGS. 1, 5A, and 5B, the hull 10 of the jet boat 1 according to a preferred embodiment of the present invention includes a keel 13 that extends in the fore and aft direction of the jet boat 1. The keel 13 extends along a middle of the hull 10 in the width direction of the jet boat 1 and preferably defines a lowermost portion of the hull 10. The keel 13 preferably extends along the entire or substantially the entire length of the lowermost portion of the hull 10. As described in more detail below, the keel 13 preferably extends from a forward most portion of the hull 10 to a water intake port 22 that supplies water to the jet propulsion nozzle 20.

Figure 2:
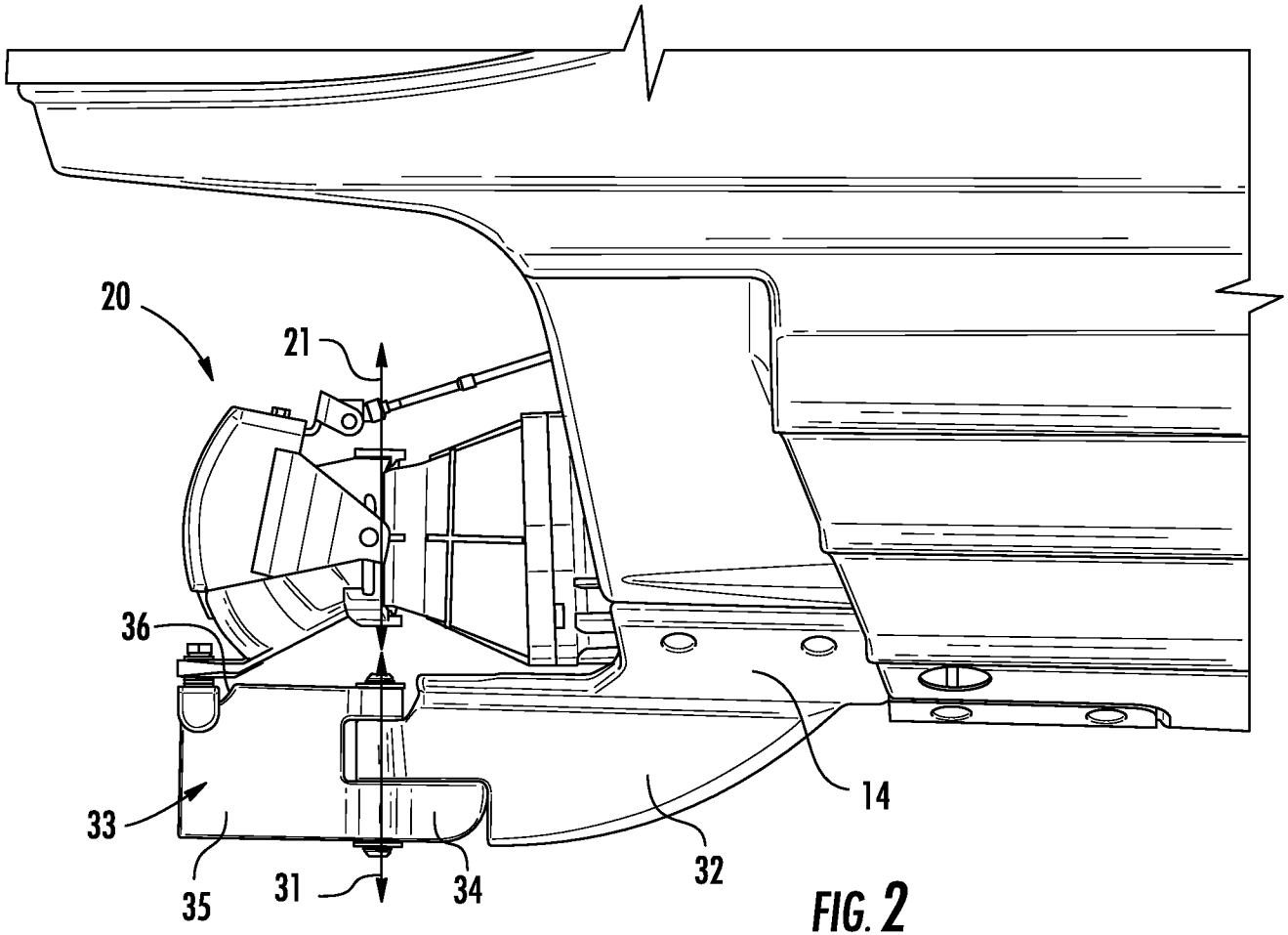
FIG. 2 is a side view of the stern of the jet boat according to a preferred embodiment of the present invention.
Figure 3:
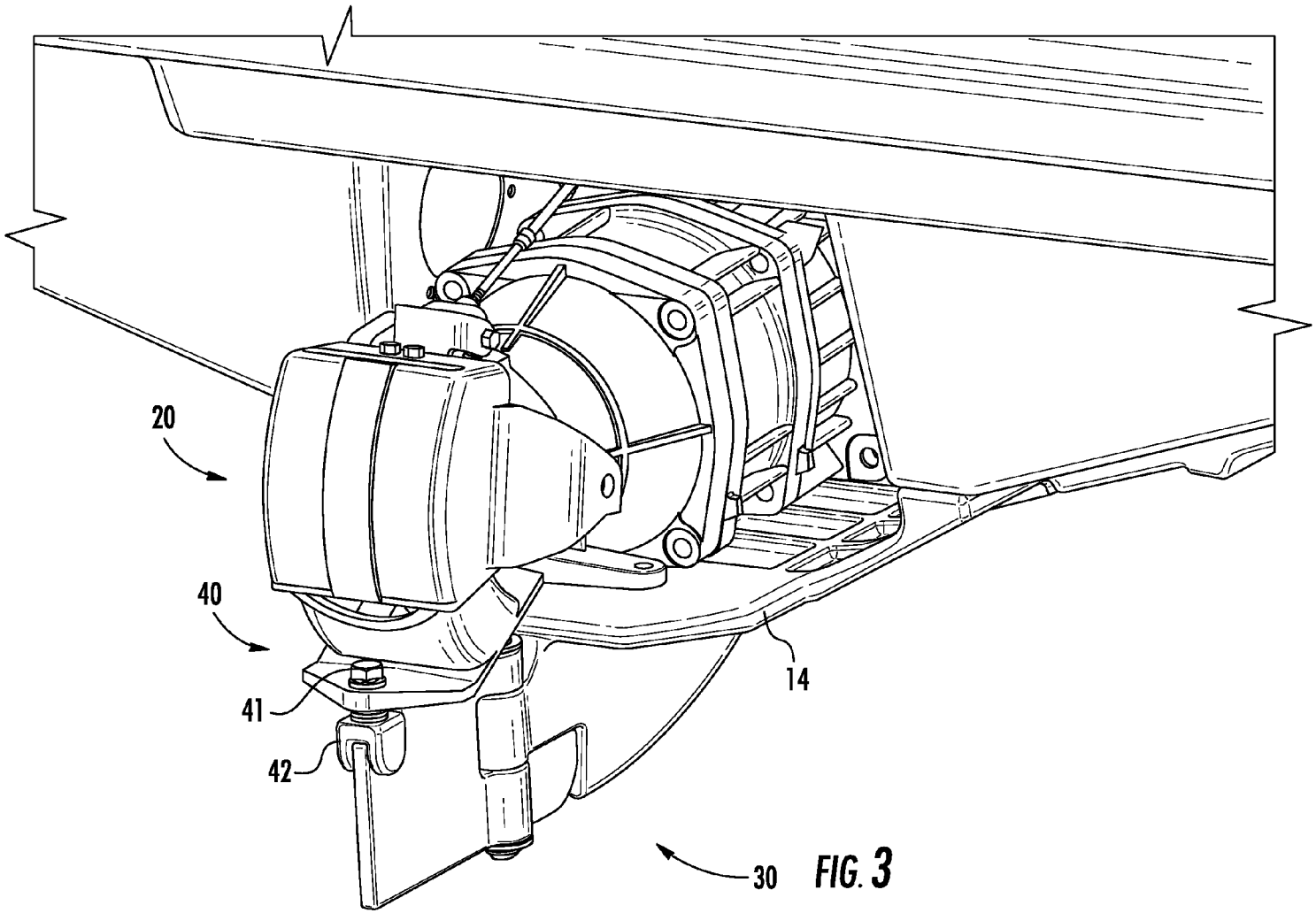
FIG. 3 is a perspective rear view of the stern of the jet boat from above according to a preferred embodiment of the present invention.
Figure 4:
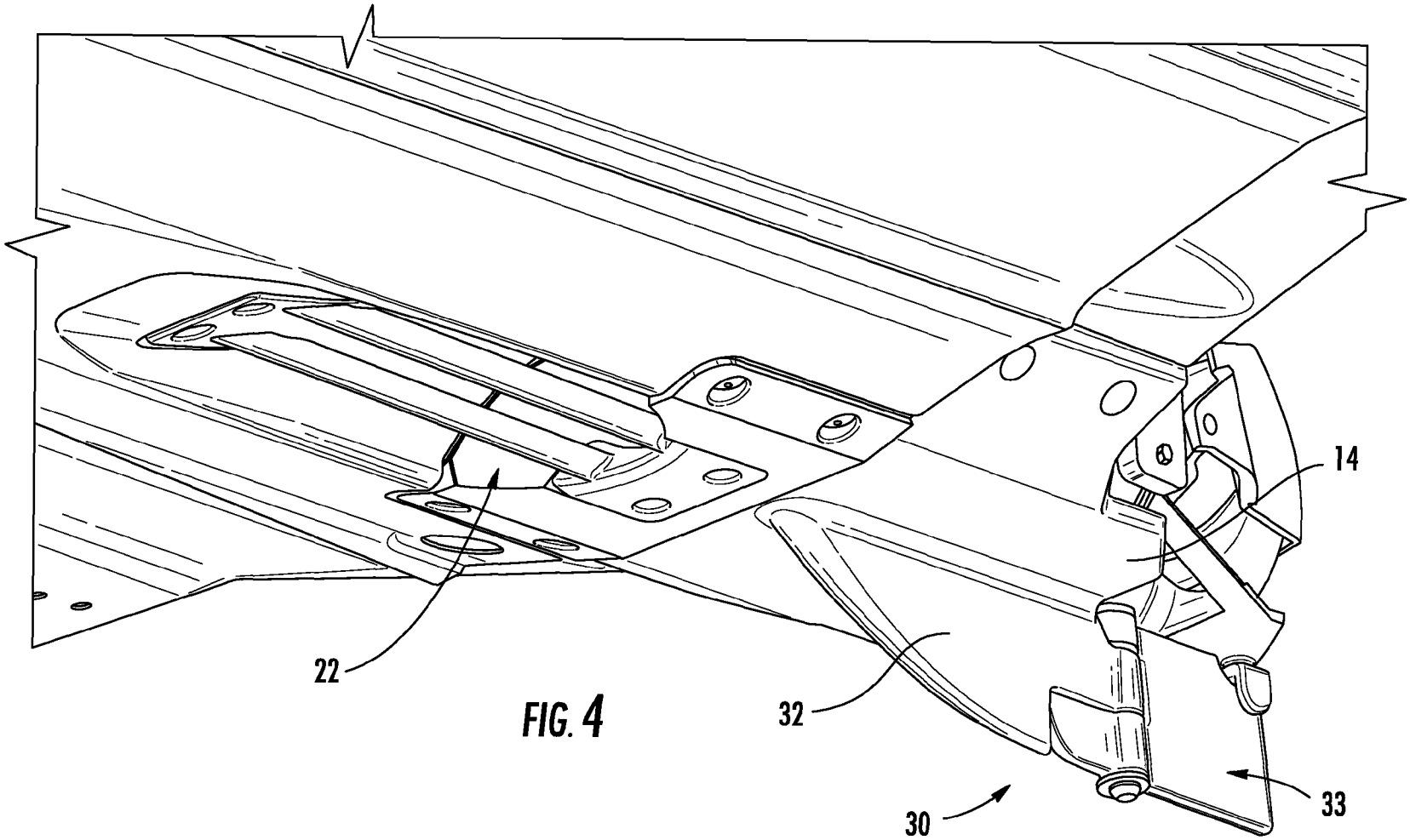
FIG. 4 is a perspective rear view of the stern of the jet boat from below according to a preferred embodiment of the present invention.
Figure 6:
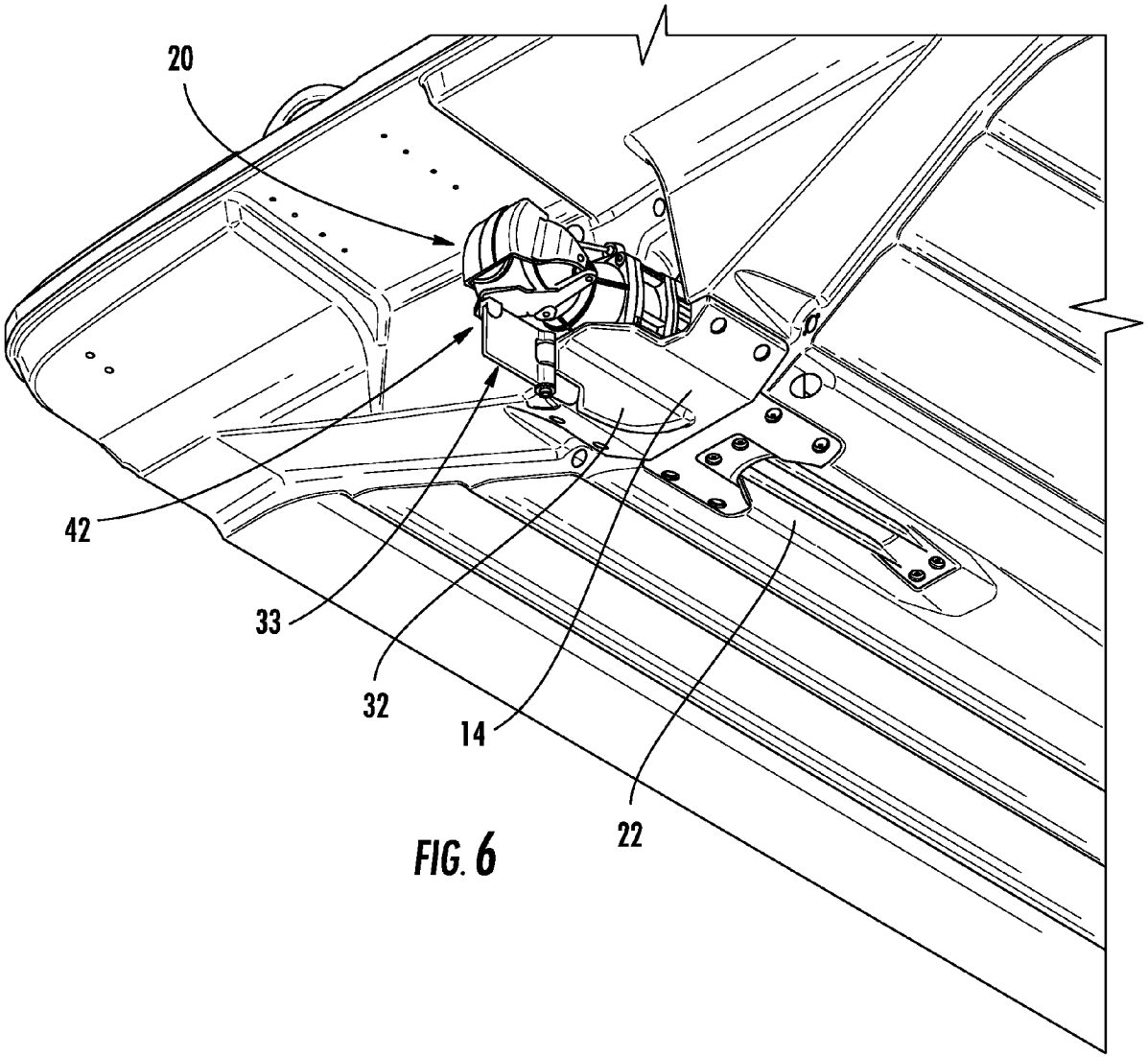
FIG. 6 is another perspective rear view of the stern of the jet boat from below according to a preferred embodiment of the present invention.

As shown in FIGS. 2, 3, and 4, the articulating keel 30 preferably includes a fixed portion 32 and a movable portion 33. In a preferred embodiment of the present invention, the fixed portion 32 is attached directly to a bottom surface of the hull 10. In another preferred embodiment of the present invention, as shown in FIGS. 2 and 6, the fixed portion 32 is attached directly to a ride plate 14 that is attached to the bottom surface of the hull 10. The ride plate 14 is attached to the bottom surface of the hull 10 in any known manner, including, for example, by bolts, adhesion, etc. The sides of the fixed portion 32 and the movable portion 33 are preferably flat or substantially flat. Alternatively, the articulating keel 30 may have a shape that corresponds to a shape of a rear portion of the keel 13, or any other suitable shape.

The fixed portion 32 extends downward and rearward from the bottom surface of the hull 10. Preferably, the front of the fixed portion 32 is curved. More preferably, the front of the fixed portion 32 is curved and has a curvature that corresponds or substantially corresponds to a curvature of the front 12 of the hull 10. Alternatively, the front and the bottom surface of the fixed portion 32 define a continuous curve, as shown in FIGS. 2 and 4. The fixed portion 32 extends rearward to a second pivot axis 31 where the fixed portion 32 is connected to the movable portion 33 of the articulating keel 30. In a preferred embodiment of the present invention, as shown in FIG. 2, the fixed portion 32 extends rearward from a rear 11 of the hull 10 so as to extend directly below a forward portion of the jet propulsion nozzle 20. In another preferred embodiment of the present invention, as shown in FIG. 4, the fixed portion 32 extends rearward to the rear 11, or approximately to the rear 11, of the hull 10.

The movable portion 33 of the articulating keel 30 is connected to the fixed portion 32 at the second pivot axis 31. Any known connecting structure may be used to connect the movable portion 33 to the fixed portion 32, including, for example, a bolt and a nut. The movable portion 33 is configured to turn or pivot with respect to the fixed portion 32 when the jet propulsion nozzle 20 is turned or steered. The jet propulsion nozzle 20 may be steered by any known steering mechanism. The movable portion 33 preferably includes a first portion 34 that extends forward of the second pivot axis 31 and a second portion 35 that extends rearward of the second pivot axis 31. In this case, the fixed portion 32 is shaped to accommodate the first portion 34 of the movable portion 33. When the first portion 34 of the movable portion 33 extends forward of the second pivot axis 31, the steerability of the jet boat 1 is further enhanced. Alternatively, the entire movable portion 33 may be located rearward of the second pivot axis 31 in the fore and aft direction of the jet boat 1.

The movable portion 33 is connected to the jet propulsion nozzle 20 at a connecting portion 40 such that, as the jet propulsion nozzle 20 is steered to the left and right about a first pivot axis 21, the movable portion 33 is turned to the left and right about the second pivot axis 31. Preferably, the movable portion 33 is located directly below the jet propulsion nozzle 20 such that the movable portion 33 and the jet propulsion nozzle 20 pivot about the same axis. In particular, the second pivot axis 31 is preferably coaxial with the first pivot axis 21 such that the movable portion 33 smoothly pivots with the jet propulsion nozzle 20.

As shown in FIG. 3, the connecting portion 40 connects a rearward top surface of the movable portion 33 to the jet propulsion nozzle 20. In a preferred embodiment of the present invention, the connecting structure 40 includes a bolt 41 secured to a portion of the jet propulsion nozzle 20 with a nut. The bottom of the bolt 41 is preferably connected to an upside down U-shaped or substantially U-shaped guide plate 42 that secures the movable portion 33 in a slot defined by the U-shape of the guide plate 42. The shape of the guide plate 42 allows the jet propulsion nozzle 20 to be securely connected to the movable portion 33 while keeping the thickness of the movable portion 33 to a minimum. Preferably, the rearward top surface of the movable portion 33 includes a recess 36 to accommodate the guide plate 42. Alternatively, the connecting portion 40 may include any known connecting structure that allows the jet propulsion nozzle 20 to be securely connected to the movable portion 33. For example, the connecting portion may include a ball screw, or any other suitable mechanical connecting element.

A length of the fixed portion 32 in the fore and aft direction of the jet boat is preferably between about 2 times to about 3 times a length of the movable portion 33 in the fore and aft direction of the jet boat 1. Alternatively, the length of the fixed portion 32 may be about the same as the length of the movable portion 33 in the fore and aft direction of the jet boat 1. It is also possible that the length of the fixed portion 32 of the articulating keel is many times longer than the length of the movable portion 33 in the fore and aft direction of the jet boat 1.

As shown in FIGS. 4, 5B, and 6, the bottom surface of the hull 10 includes a water intake port 22 to supply water to the jet propulsion nozzle 20. The water intake port 22 is preferably located in the middle of the hull 10 in a width direction of the jet boat 1, and aligned with the keel 13 of the hull 10 and the articulating keel 30 in the fore and aft direction of the jet boat 1. For example, the water intake port 22 is located at the rear of the keel 13 and forward of the articulating keel 30.

Preferably, the hull 10 is designed such that a bottom surface of the hull 10 inclines upward as the hull 10 extends rearward, such that the front 12 of the hull 10 sits lower in the water than the rear end 11 of the hull 10, whether the hull 10 is flat or substantially flat or includes a keel 13. For example, the hull 10 inclines upward by a distance that is the same or substantially the same as a distance the articulating keel 30 extends below a bottom surface of the rear 11 of the hull 10. As shown in FIGS. 1 and 5A, a horizontal line is aligned with a bottom surface of the front 12 of the hull 10 and a bottom surface of the articulating keel 30. Alternatively, the bottom surface of the articulating keel 30 may be slightly above or slightly below the bottom surface of the front 12 of the hull 10.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet boat comprising:
a hull;
a jet propulsion nozzle mounted to a rear of the hull;
a water intake port that supplies water to the jet propulsion nozzle;
an articulating keel attached at the rear of the hull; and
a connecting portion that connects the jet propulsion nozzle and the articulating keel; wherein
the jet propulsion nozzle includes a first pivot axis extending vertically or substantially vertically;
the articulating keel includes a second pivot axis extending vertically or substantially vertically;
the first pivot axis of the jet propulsion nozzle is coaxial with the second pivot axis of the articulating keel; and
the water intake port is located forward of the first pivot axis and the second pivot axis and an entirety of the connecting portion is located rearward of the first pivot axis and the second pivot axis.

2. The jet boat according to claim 1, wherein a bottom surface of the hull inclines upward as the hull extends rearward.

3. The jet boat according to claim 1, wherein the articulating keel is located at a centerline of the hull in a width direction of the jet boat.

4. The jet boat according to claim 1, wherein the hull has a flat or substantially flat bottom surface.

5. The jet boat according to claim 1, wherein the hull includes a keel extending from a front of the hull to the rear of the hull, and the articulating keel is aligned with the keel in the fore and aft direction of the jet boat.

6. The jet boat according to claim 1, wherein a bottom surface of the articulating keel extends below a bottom surface of the hull.

7. The jet boat according to claim 1, wherein the connecting portion is located rearward of the first pivot axis and the second pivot axis in a fore and aft direction of the jet boat.

8. The jet boat according to claim 1, wherein the connecting portion includes a bolt.

9. The jet boat according to claim 1, wherein the hull includes a keel extending from a front of the hull toward the rear of the hull, and the water intake port is located between the keel and the articulating keel.

10. The jet boat according to claim 1, further comprising a ride plate attached to bottom surface of the hull, and the articulating keel is directly attached to the ride plate.

11. A jet boat comprising:
a hull;
a jet propulsion nozzle mounted to a rear of the hull;
an articulating keel attached at the rear of the hull; and
a connecting portion that connects the jet propulsion nozzle and the articulating keel; wherein
the jet propulsion nozzle includes a first pivot axis extending vertically or substantially vertically;
the articulating keel includes a second pivot axis extending vertically or substantially vertically;
the first pivot axis of the jet propulsion nozzle is coaxial with the second pivot axis of the articulating keel; and
the articulating keel includes a fixed portion and a movable portion, and the fixed portion is attached to the movable portion at the second pivot axis.

12. The jet boat according to claim 11, wherein the movable portion includes a forward portion located forward of the second pivot axis and a rear portion located rearward of the second pivot axis in a fore and aft direction of the jet boat.

13. The jet boat according to claim 11, wherein the fixed portion of the articulating keel is attached directly to the hull.

14. The jet boat according to claim 11, wherein a front of the fixed portion of the articulating keel is curved, and a curvature of the front of the fixed portion substantially corresponds to a curvature of a front of the hull.

15. The jet boat according to claim 11, wherein the movable portion of the articulating keel is located directly below the jet propulsion nozzle.

16. The jet boat according to claim 11, wherein the fixed portion of the articulating keel defines a portion of a bottom surface of the hull.

17. The jet boat according to claim 11, wherein a rear portion of the fixed portion of the articulating keel extends rearward of the rear of the hull.

18. The jet boat according to claim 11, wherein a length of the fixed portion of the articulating keel in the fore and aft direction of the jet boat is between about 2 times to about 3 times a length of the movable portion of the articulating keel in the fore and aft direction of the jet boat.

19. A jet boat comprising:
a hull;
a jet propulsion nozzle mounted to a rear of the hull;
an articulating keel attached at the rear of the hull; and
a connecting portion that connects the jet propulsion nozzle and the articulating keel; wherein the jet propulsion nozzle includes a first pivot axis extending vertically or substantially vertically;

the articulating keel includes a second pivot axis extending vertically or substantially vertically;

the first pivot axis of the jet propulsion nozzle is coaxial with the second pivot axis of the articulating keel; and a bottom surface of the articulating keel is located on a horizontal line extending from a bottom surface of a front of the hull.

20. A jet boat comprising:

a hull;

a jet propulsion nozzle mounted to a rear of the hull;

an articulating keel attached at the rear of the hull; and a connecting portion that connects the jet propulsion nozzle and the articulating keel; wherein the jet propulsion nozzle includes a first pivot axis extending vertically or substantially vertically;

the articulating keel includes a second pivot axis extending vertically or substantially vertically;

the first pivot axis of the jet propulsion nozzle is coaxial with the second pivot axis of the articulating keel; and the connecting portion includes a U-shaped or substantially U-shaped guide plate including a slot in which the articulating keel is located.

* * * * *